US005551803A

United States Patent [19]

Pallini, Jr. et al.

[11] Patent Number: 5,551,803

[45] Date of Patent: Sep. 3, 1996

[54] RISER TENSIONING MECHANISM FOR FLOATING PLATFORMS

[75] Inventors: Joseph W. Pallini, Jr., Tomball; Charles E. Jennings, Houston, both of Tex.

[73] Assignee: ABB Vetco Gray, Inc., Houston, Tex.

[21] Appl. No.: 321,044

[22] Filed: Oct. 5, 1994

[51] Int. Cl.[6] ..... E21B 17/07

[52] U.S. Cl. ..... 405/223.1; 166/355

[58] Field of Search ..... 166/350, 355, 166/367; 405/224.2, 223.1, 168.4; 175/7

[56] References Cited

U.S. PATENT DOCUMENTS

| | | | |
|---|---|---|---|
| 4,004,532 | 1/1977 | Reynolds . | |
| 4,039,177 | 8/1977 | Person et al. . | |
| 4,215,950 | 8/1980 | Stevenson | 405/224.2 X |
| 4,362,438 | 12/1982 | Spink . | |
| 4,616,707 | 10/1986 | Langner | 166/355 X |
| 4,616,708 | 10/1986 | da Mota | 166/355 |
| 4,617,998 | 10/1986 | Langner | 166/355 X |
| 4,787,778 | 11/1988 | Myers et al. | 405/223.1 X |
| 4,799,827 | 1/1989 | Jaqua . | |
| 4,883,387 | 11/1989 | Myers et al. | 166/367 X |
| 4,883,388 | 11/1989 | Cherbonnier | 166/355 X |
| 4,892,444 | 1/1990 | Moore | 405/223.1 X |
| 5,160,219 | 11/1992 | Arlt | 166/350 X |
| 5,310,007 | 5/1994 | Parikh | 166/355 |

*Primary Examiner*—Frank Tsay
*Attorney, Agent, or Firm*—James E. Bradley

[57] ABSTRACT

An apparatus for tensioning a riser that extends from a floating platform to a subsea wellhead has hydraulic cylinders. The hydraulic cylinders attach between the platform and the riser in a cluster with the axis of the riser substantially parallel with the axes of the hydraulic cylinders. A guide sleeve within the cluster transfers bending moments of the riser to the platform.

18 Claims, 4 Drawing Sheets

RISER TENSIONING MECHANISM FOR FLOATING PLATFORMS

BACKGROUND OF THE INVENTION

1. Field of the Invention

This invention relates in general to offshore oil and gas floating platforms, and in particular to an apparatus for tensioning risers extending from a subsea wellhead to a floating platform.

2. Description of the Prior Art

Offshore production platforms must support production risers from oil or gas wells which extend to the platform from subsea wells. For platforms that are fixed to the ocean floor this is readily accomplished and is well known in the art. However, for subsea completions in deep water that require the use of floating platforms, such as tension leg platforms or semi-submersible platforms, supporting risers present significant problems. These platforms move under the influence of waves, wind, and current. Thus, the riser tensioning mechanism must permit the platform to move relative to the riser.

The riser tensioning mechanism must also maintain the riser in tension so that the weight of the riser is not transferred to the wellhead and so that the riser does not collapse under its own weight. The tensioning mechanism must therefore exert a continuous tensional force on the riser. Also, this force must be maintained within a narrow tolerance.

The use of a hydraulic cylinders attached between a platform and a riser to support the weight of the riser is well known in the art. However, due to the long life of production platforms, it has been necessary to have backup systems so that repairs can be made to the hydraulic cylinders in cases of failure. One such device is described in the U.S. Pat. No. 4,004,532 to Reynolds. That patent discloses an apparatus that requires a completely redundant backup system comprising one or more sets of two in-line hydraulic heave compensator cylinder units, one of the cylinder units being the primary heave compensator unit, the other serving as a backup unit in the event of primary unit failure. Each unit in that system has its own dedicated air/oil accumulator and its own independent air pressure vessel.

In another previously known device a control system is used to charge the hydraulic cylinders. When one pair of hydraulic cylinders experiences a reduction in pressure, the control system isolates and completely relieves the pressure in that pair, while the other cylinder pairs are charged to twice the normal pressure in order to maintain a constant tensioning force. This system, however, requires separate high pressure containers to charge each of the hydraulic cylinders. Also, there is a period of elapsed time that is required before the system can register the pressure deficiency and perform the necessary switching. During this time substantial bending moments are present in the riser which can result in damage to the riser or the support system.

Another tensioning system is disclosed in U.S. Pat. No. 4,362,438, which does not require connection between the hydraulic cylinders and separate control system. This patent describes an apparatus with hydraulic cylinders that have internal valves that open and close, allowing hydraulic fluid to travel through internal conduits to compensate for pressure changes caused by riser movement relative to the platform. This system, however, provides no protection against bending moment stresses caused by failure of hydraulic cylinders.

SUMMARY OF THE INVENTION

The present invention disclosed herein comprises an apparatus for tensioning risers on floating platforms that includes a plurality of hydraulic cylinders, each having an axis. The hydraulic cylinders attach the riser with the platform. Each hydraulic cylinder also has a base end and a cylinder housing having a chamber. The chamber contains hydraulic fluid that urges a piston rod in a direction opposite the base end. The piston rod extends along the axis of the hydraulic cylinder and has a rod end opposite the chamber of the hydraulic cylinder.

The cylinder housing is rigidly supported by a receiver. The receiver is connected to the platform by support members such as struts or flex pads. The rod ends of the piston rods are attached to a riser collar. The riser collar supportably engages the riser with the axes of the hydraulic cylinders substantially parallel with the axis of the riser. The hydraulic cylinders support the weight of the riser, thereby providing a tensioning force to the riser.

Each hydraulic cylinder also has an in-line coaxial accumulator that maintains a high pressure on the hydraulic fluid such that the pistons automatically move in response to changes in the position of the platform. This automatic reaction allows for relative movement between the riser and the platform which compensates for the rise and fall of the platform. Additionally, in the event of a hydraulic cylinder failure, the support members and the receiver transfer the bending moment on the riser to the platform instead of the cylinders.

DETAILED DESCRIPTION OF THE INVENTION

Figure 1:
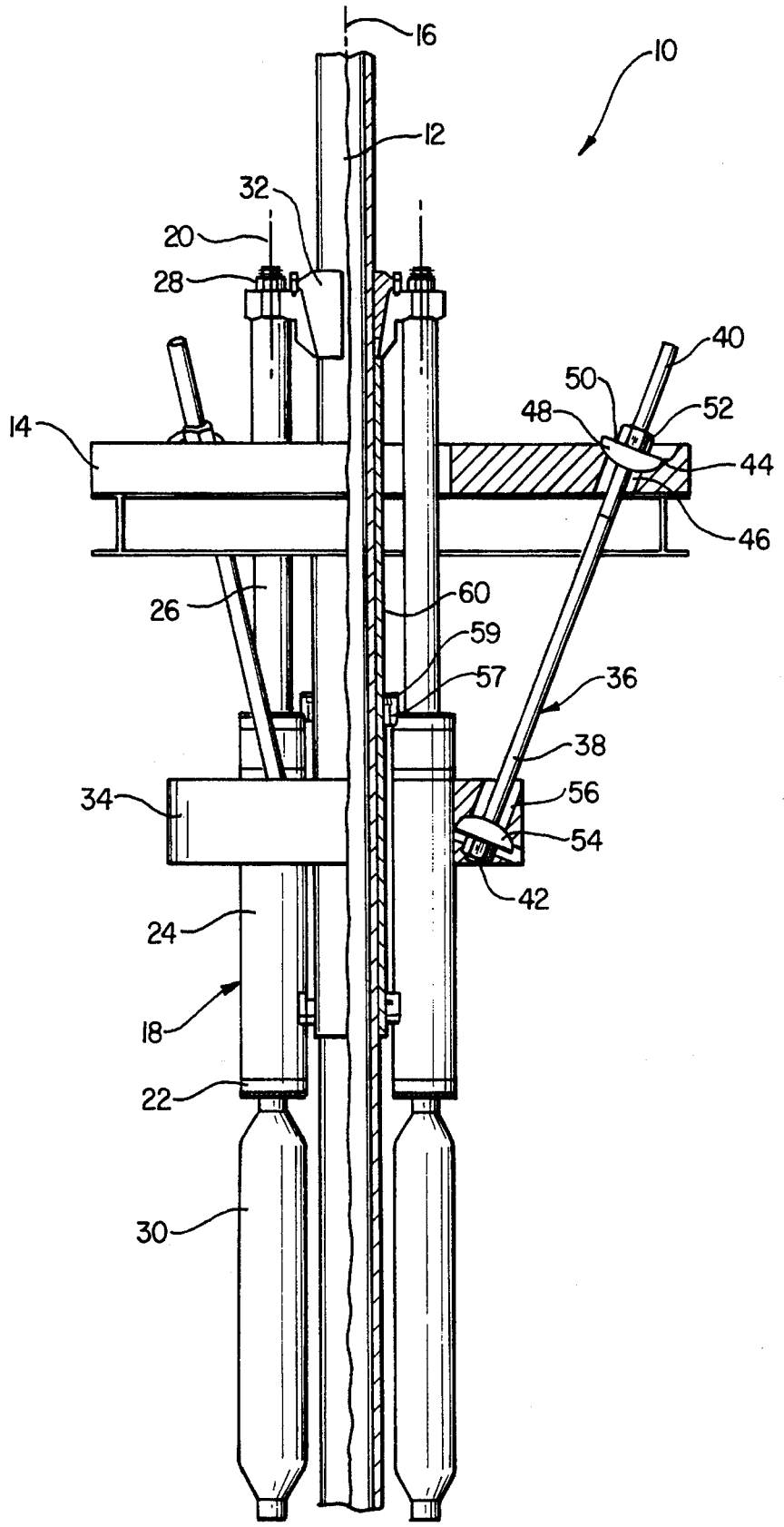
FIG. 1 is a sectional view of a floating platform with a riser supported by a tensioning mechanism constructed in accordance with this invention.

Referring to FIG. 1, a drawing representing a riser tensioning mechanism 10 is depicted. A riser 12 extends downwardly from a platform 14 to a subsea wellhead (not shown). Riser 12 has a longitudinal axis 16. Riser 12 is surrounded by a plurality of hydraulic cylinders 18. Each hydraulic cylinder 18 has a longitudinal axis 20 which is substantially parallel to axis 16 of riser 12. Each hydraulic cylinder 18 also has a base end 22 and a cylinder housing 24 having a chamber (not shown). A piston rod 26 having a rod end 28 extends upward from each cylinder housing 24 along axis 20 of hydraulic cylinder 18. The piston ends opposite rod ends 28 are disposed within the respective chambers (not shown) of cylinder housings 24. Hydraulic fluid (not shown) is contained within the housing 24 for urging piston rod 26 upward in a direction opposite base end 22 of hydraulic cylinder 18. Each hydraulic cylinder 18 also has accumulator 30 extending downward from base end 22 coaxially along axis 20 of hydraulic cylinder 18 for accumulating the hydraulic fluid during compression of hydraulic cylinder 18 and for maintaining high pressure on the hydraulic fluid.

A riser collar 32 rigidly connects to riser 12. The piston rods 26 attach to riser coller 32 at the rod ends 28. A cylinder receiver 34 rigidly connects to cylinder housings 24. Cylinder receiver 34 is a plate having a hole through it for connection to each of the cylinder housings 24. The connection of hydraulic cylinders 18 to receiver 34 and the connection of piston rods 26 to riser coller 32 are axially aligned with each other so that axes 20 of hydraulic cylinders 18 are substantially parallel with axis 16 of riser 12. Hydraulic cylinders 18 will be in a cluster surrounding and parallel to riser 12.

A plurality of support members 36 are attached between cylinder receiver 34 and platform 14. In the embodiment of FIG. 1, support members 36 are adjustable rigid rods or struts 38, each having an upper end 40 and a lower end 42. Adjustable struts 38 extend generally downwardly and inwardly from platform 14 to cylinder receiver 34 at an acute angle relative to axis 16 of riser 12.

Platform 14 has a plurality of bearing seats 44 having holes 46 therethrough. Upper ends 40 of adjustable struts 38 extend through holes 46 of bearing seats 44. A plurality of spherical bearings 48 rotatively engage respective bearing seats 44. Spherical bearings 48 each have bores 50. Upper ends 40 of adjustable struts 38 extend through bores 50. Upper ends 40 of adjustable struts 38 are threaded. Nuts 52 screw onto adjustable strut upper ends 40, securing spherical bearings 48 to bearing seats 44 in a manner such that adjustable struts 38 pivotally couple to platform 14 and so that the length of adjustable struts 38 can be changed. Once adjusted, the length of each strut 38 is does not vary, as the struts 38 are rigid.

Similarly, cylinder receiver 34 has a plurality of bearing seats 54 having holes 56 therethrough. Lower ends 42 of adjustable struts 38 extend through holes 56 of respective bearing seats 54. A plurality of spherical bearings 48 rotatably engage bearing seats 54. Spherical bearings 48 each have bores 50. Lower ends 42 of adjustable struts 38 extend through bores 50. Lower ends 42 of adjustable struts 38 are threaded. Nuts 52 screw onto adjustable strut lower ends 42, securing spherical bearings 48 to bearing seats 54 in a manner such that adjustable struts 38 pivotally couple to cylinder receiver 34 and so that the length of adjustable struts 38 can be changed.

Figure 3:
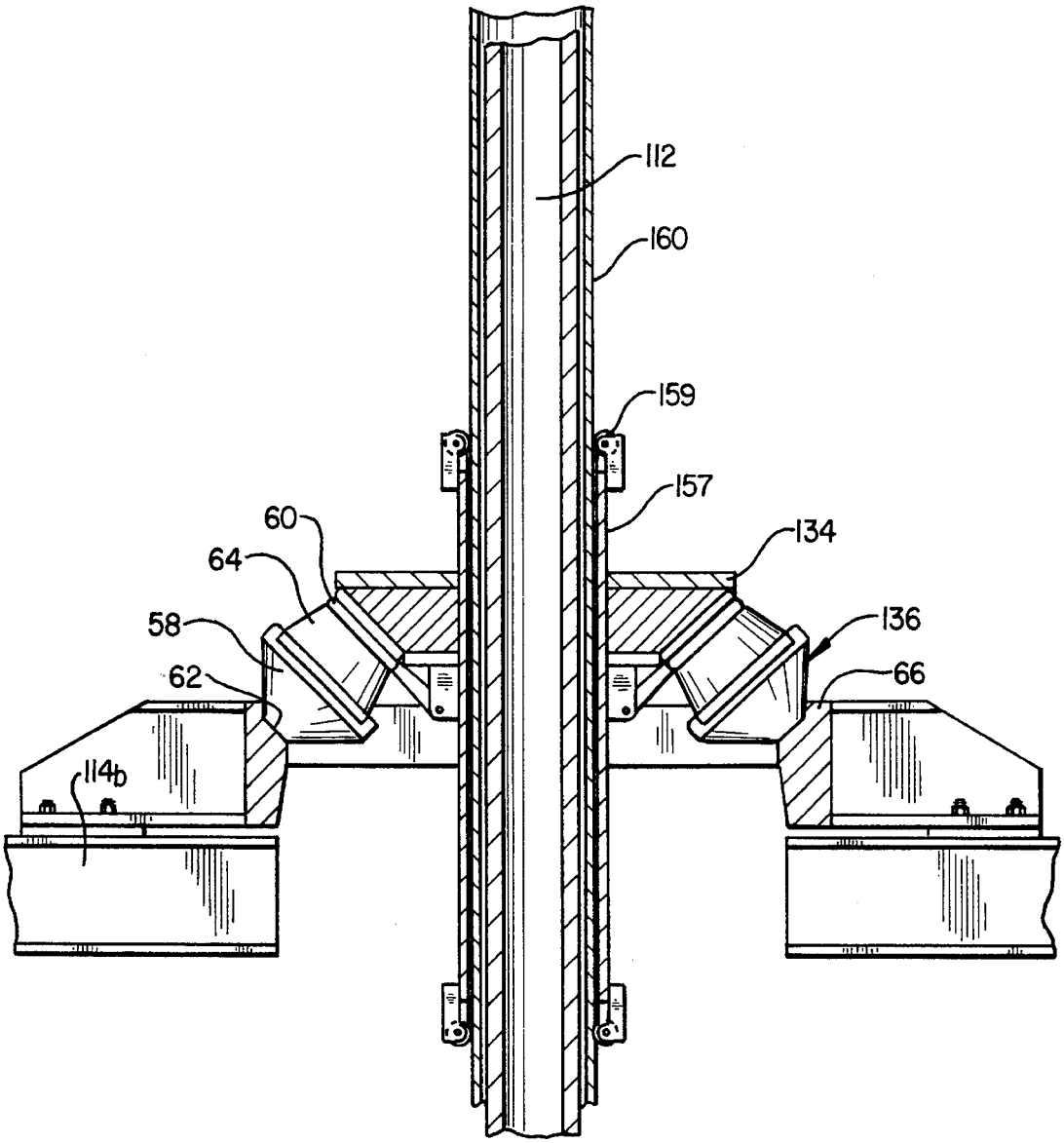
FIG. 3 is an enlarged partial sectional view of the tensioning mechanism of FIG. 2, with cylinders not being shown.

A guide sleeve 57 is rigidly attached to cylinder receiver 34. The second embodiment, as shown in FIG. 3 has a similar guide sleeve, which is more clearly shown. Guide sleeve 57 is disposed within cylinder receiver 34 and receives riser 12. A riser sleeve 60 is rigidly secured to riser collar 32 and extends downward to a point approximately one-fourth from the base end 22 of cylinder housings 24. Riser sleeve 60 encloses a portion of riser 12, and because of its rigid connection to riser collar 32, may be considered a part of riser 12. A clearance is located between guide sleeve 57 and riser sleeve 60, which allows guide sleeve 57 to freely move axially relative to riser 12 and riser sleeve 60. The upper end of guide sleeve 57 is above the upper ends of cylinders 24. The lower end of guide sleeve 57 is below the midpoint of cylinders 24 but above the lower ends 22. A plurality of guide wheels 59 are mounted to the upper and lower ends of guide sleeve 57 to rotatably engage riser sleeve 60.

In operation, platform 14 supportably engages adjustable struts 38 which connect to cylinder receiver 34 which in turn supports hydraulic cylinders 18. Riser collar 32 connects to hydraulic cylinders 18 and engages riser 12 above cylinder receiver 18. Hydraulic fluid pressure is applied to hydraulic cylinders 18 so that riser 12 is maintained in constant tension. Riser collar 32 supports the weight of riser 12 in order to create a tensional force in riser 12. Hydraulic cylinders 18 in combination with struts 38 automatically adjust to changes in platform 14 position to allow for relative movement between riser 12 and platform 14. Rollers 59 roll on riser sleeve 60 as platform 14 moves vertically relative to riser 12.

Any bending moments on riser 12 due to angular offset with platform 14 are transferred through rollers 59 to guide sleeve 57 and to receiver 34. The bending moments transfer through struts 38 to platform 14, isolating the cylinders 18 from the bending moments. In the event of a failure in one of the four hydraulic cylinders 18, the remaining hydraulic cylinders 18 will continue to support riser 12 in tension without excessive bending moments being applied to the hydraulic cylinders 18. Adjustable struts 38 transfer bending moments from riser tensioning mechanism 10 to platform 14.

Figure 2:
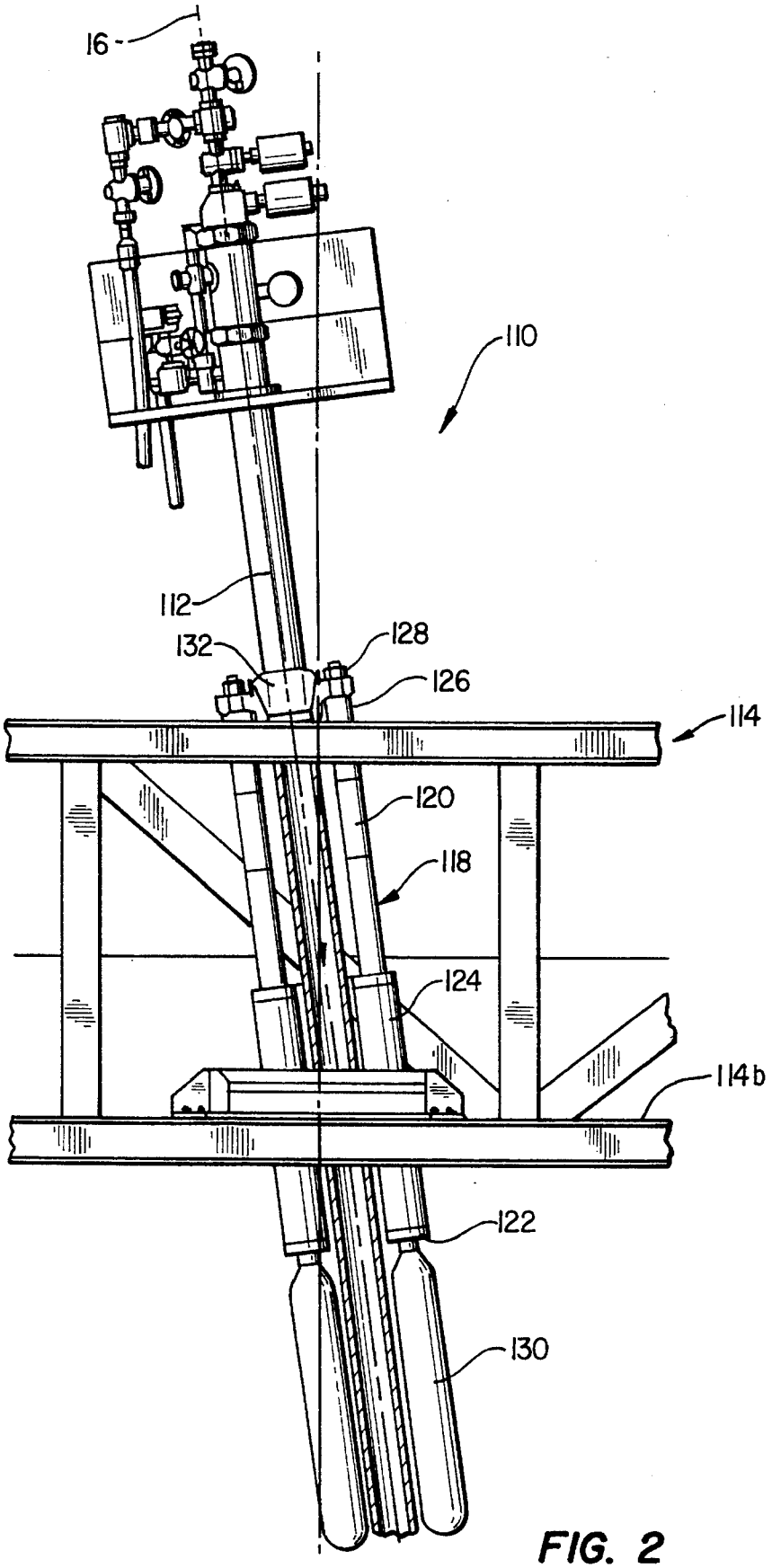
FIG. 2 is a side view of an alternate embodiment of a riser tensioning mechanism.
Figure 4:
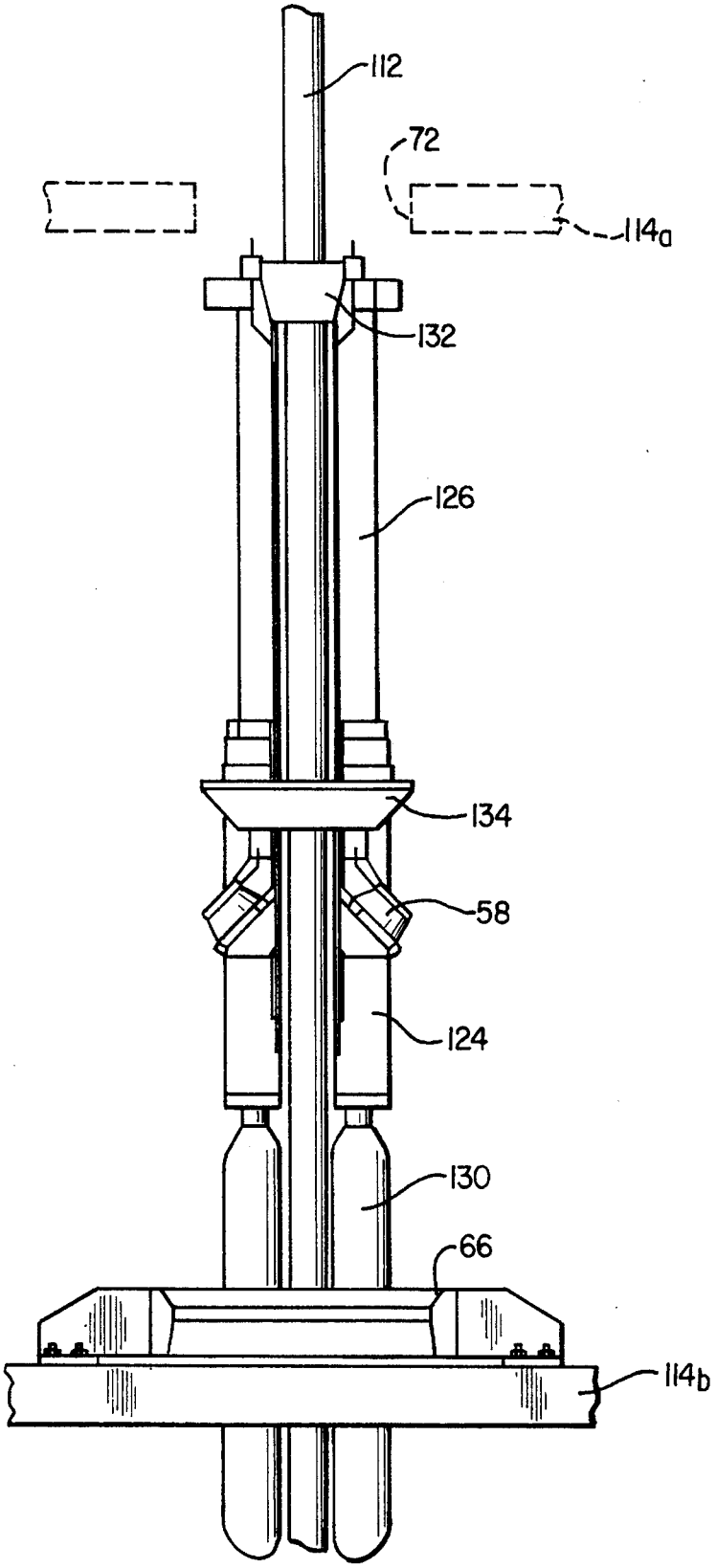
FIG. 4 is a schematic view of the tensioning mechanism of FIG. 2 during installation of the mechanism.

An alternate embodiment is shown in FIGS. 2–4. Referring to FIG. 2, riser 112 has longitudinal axis 116. Riser 112 is surrounded by a cluster of hydraulic cylinders 118. Each hydraulic cylinder 118 has a longitudinal axis 120 which is substantially parallel to axis 116 of riser 112. Each hydraulic cylinder 118 also has a base end 122 and a cylinder housing 124 having a chamber (not shown). A piston rod 126 having a rod end 128 extends upward from each cylinder housing 124 along axis 120 of hydraulic cylinder 118. The piston ends opposite rod ends 128 are disposed within the respective chambers (not shown) of cylinder housings 124. Hydraulic fluid (not shown) is contained within the chambers for urging piston rod 126 in an upward direction opposite base end 122 of hydraulic cylinder 118. Each hydraulic cylinder 118 also has an accumulator 130 extending downwardly from base end 122 along axis 120 of hydraulic cylinder 118 for accumulating the hydraulic fluid during compression of hydraulic cylinder 118 and for maintaining high pressure on the hydraulic fluid.

Rod ends 128 of piston rods 126 connect to a riser collar 132. Riser collar 132 rigidly connects to riser 112 so that the axes 120 of hydraulic cylinders 118 are substantially parallel with axis 116 of riser 112. Riser collar 132 supports the weight of riser 112 in order to create a tensional force in riser 112.

Now referring to FIG. 3, cylinder receiver 134 is supported by a plurality of support members 136 that are attached between cylinder receiver 134 and a lower floor portion **114*b* of the platform. Support members 136 are flexible pads 58. Flexible pads 58 have upper metallic landings 60 that supportably engage cylinder receiver 134. Flexible pads 58 also have lower metallic landings 62 that are supported by the lower floor portion 114*b*. Flexible pads 58 further have elastomeric plates 64 between respective upper metallic landings 60 and lower metallic landing 62, creating laminated metal-elastomeric flexible pads. Lower metallic landings 62 of flexible pads 58 engage flexible pad seats 66 on the lower floor portion 114*b***.

As shown in FIG. 3, a guide sleeve 157 is rigidly attached to cylinder receiver 134. The cylinders 118 are not shown in FIG. 3 for clarity. Guide sleeve 157 is disposed within cylinder receiver 134 and receives riser sleeve 160. Riser sleeve 160 depends downward from riser collar 132 (FIG. 2) and encloses a portion of riser 112. A clearance exists between guide sleeve 157 and riser sleeve 160, which allows guide sleeve 157 to move axially relative to riser sleeve 160 and riser 112. A plurality of guide wheels 159 are mounted to the upper and lower ends of guide sleeve 157 to rotatably engage riser sleeve 160. The upper end of guide sleeve 157 is above the upper ends of cylinders 124. The lower end of guide sleeve 157 is below the midpoint of cylinders 124 but above the lower ends 122.

Referring now to FIG. 4, flexible pads 58 are pivotally coupled to cylinder receiver 134 for ease in installation of riser 112. During installation, flexible pads 58 pivot to a contracted position, reducing the outer diameter of the assembled pads 58 to less than the diameter of the rotary table opening or slot 72 in an upper floor portion or rig floor 114*a* of the platform. The outer diameters of the riser collar 132 and cylinder receiver 134 are also less than the diameter of platform well slot 72. This allows the hydraulic cylinders 126 and accumulators 130 to be mounted to the riser 112 above the upper floor portion 114*a* and lowered along with the riser as an assembly below the upper floor portion 114*a*. After passing below rotary table opening 72, flexible pads 58 are pivoted into an expanded operating position and land on the seat 66 in the lower floor portion 114*b*.

In the operation of the embodiment of FIGS. 2–4, platform lower floor portion 114*b* supportably engages flexible pads 58 upon which cylinder receiver 134 is mounted. Cylinder receiver 134 supports hydraulic cylinders 118. Riser collar 132 connects to hydraulic cylinders 118 and engages riser 112 so that riser 112 is maintained in constant tension. Hydraulic cylinders 118 in combination with flexible pads 58 automatically adjust to changes in platform 114 position to allow for relative movement between riser 112 and platform 114. As platform 114 moves upward and downward, rollers 159 (FIG. 3) will roll axially on the riser sleeve 160.

In the event of a failure of one of the four hydraulic cylinders 118, the other hydraulic cylinders 118 will maintain the tension without excessive bending moments. The guide sleeve 157 and flexible pads 58 transfer bending moments from riser tensioning mechanism 110 to platform 114. As shown in FIG. 2, large angular offsets can occur due to wind and current, without transferring large moments to the cylinders 118. The bending moment of riser 114 transfers through the rollers 159 (FIG. 3) and guide sleeve 157 directly to cylinder receiver 134 and platform 114, isolating the cylinders 118 from the bending moments. All of the cylinders 118 are stroked and loaded the same despite the large angular offset between the riser 112 and platform 114.

The invention has significant advantages. Mounting the cylinders parallel to the axis of the riser avoids excessive bending forces being applied to the cylinders, particularly in the event of a failure of one of the cylinders. The assembly can be mounted to the riser, then lowered through the platform floor, making installation easier than in prior art types. The parallel axes of the assembly and coaxial accumulators reduce space requirements. Large angular offsets can occur due to wind and current, without transferring large moments to the cylinders.

While only two embodiments of the invention have been disclosed in the above detailed description, the invention is not limited thereto but is susceptible to various changes without departing from the scope of the invention.

We claim:

1. An apparatus for tensioning a riser having an axis, the riser extending downwardly from a platform to a subsea wellhead, the apparatus comprising:

a plurality of hydraulic cylinders, each having a piston portion, a cylinder portion, and an axis;

a plurality of accumulators, each attached to the cylinder portion of one of the hydraulic cylinders and extending coaxially along the axis of one of the hydraulic cylinders; and mounting means for mounting the hydraulic cylinders between the platform and the riser in a cluster around the riser with the axes of the hydraulic cylinders substantially parallel with the axis of the riser for applying tension to the riser and allowing movement of the platform relative to the riser; wherein the mounting means comprises:

a cylinder receiver rigidly supporting one of the portions of the hydraulic cylinders, the cylinder receiver having a hole therethrough for receiving the riser, the riser and cylinder receiver being axially movable relative to each other;

a plurality of struts extending downwardly and inwardly from the platform to the cylinder receiver to support the cylinder receiver for movement with the platform; and a riser collar rigidly connected to the riser, the other portion of each of the hydraulic cylinders being rigidly connected to the riser collar.

2. An apparatus for tensioning a riser having an axis, the riser extending downwardly from a platform to a subsea wellhead, the apparatus comprising:

a plurality of hydraulic cylinders, each having a piston portion, a cylinder portion, and an axis;

a plurality of accumulators, each attached to the cylinder portion of one of the hydraulic cylinders and extending coaxially along the axis of one of the hydraulic cylinders; and mounting means for mounting the hydraulic cylinders between the platform and the riser in a cluster around the riser with the axes of the hydraulic cylinders substantially parallel with the axis of the riser for applying tension to the riser and allowing movement of the platform relative to the riser; wherein the mounting means comprises:

a cylinder receiver rigidly supporting one portion of the hydraulic cylinders;

a plurality of flexible pads attached between the platform and the cylinder receiver to support the cylinder receiver with the platform; and a riser collar rigidly connected to the riser, the other portion of each of the hydraulic cylinders being rigidly connected to the riser collar.

3. An apparatus for tensioning a riser having an axis, the riser extending downwardly from a platform to a subsea wellhead, the apparatus comprising:

a plurality of hydraulic cylinders, each having a piston portion, a cylinder portion, and an axis;

a plurality of accumulators, each attached to the cylinder portion of one of the hydraulic cylinders and extending coaxially along the axis of one of the hydraulic cylinders; and mounting means for mounting the hydraulic cylinders between the platform and the riser in a cluster around the riser with the axes of the hydraulic cylinders substantially parallel with the axis of the riser for applying tension to the riser and allowing movement of the platform relative to the riser; wherein the mounting means comprises:

a cylinder receiver rigidly supporting the cylinder portions of the hydraulic cylinders, the cylinder receiver having a hole therethrough for receiving the riser, the riser and cylinder receiver being axially movable relative to each other;

a plurality of rigid struts extending downwardly and inwardly from the platform to the cylinder receiver to support the cylinder receiver for movement with the platform; and a riser collar rigidly connected to the riser, the piston portion of each of the hydraulic cylinders being rigidly connected to the riser collar.

4. An apparatus for tensioning a riser having an axis, the riser extending downwardly from a platform to a subsea wellhead, the apparatus comprising:

a plurality of hydraulic cylinders in a cluster surrounding the riser, each of the hydraulic cylinders having a piston portion, a cylinder portion, and an axis;

a cylinder receiver rigidly supporting one of the portions of the hydraulic cylinders;

a riser collar supportably connecting the other of the portions of each of the hydraulic cylinders to the riser, with the axes of each of the hydraulic cylinders substantially parallel with the axis of the riser;

a guide sleeve fixably attached to the cylinder receiver, the guide sleeve being disposed within the cylinder receiver and movably engaging the riser; and a plurality of support members, each supportably mounting the cylinder receiver to the platform, thereby tensioning the riser and allowing relative movement between the riser and the platform.

5. The apparatus as recited in claim 4 wherein each of the support members is a rigid strut extending downwardly and inwardly from the platform to the cylinder receiver.

6. The apparatus as recited in claim 4 wherein each of the support members comprises a flexible pad mounted between the platform and the cylinder receiver.

7. The apparatus as recited in claim 4 wherein each of the hydraulic cylinders further includes an accumulator extending from the hydraulic cylinder coaxially along the axis of the hydraulic cylinder.

8. An apparatus for tensioning a riser having an axis, the riser extending downwardly from a platform to a subsea wellhead, the apparatus comprising:

a plurality of hydraulic cylinders each having an axis, a base end, a cylinder housing, a piston rod having a rod end and extending from the cylinder housing along the axis of the hydraulic cylinder, the cylinder housing containing hydraulic fluid for urging the piston rod in a direction opposite the base end;

a cylinder receiver rigidly supporting the cylinder housings;

a plurality of support members, each attached between the hydraulic cylinder receiver and the platform, each of the support members being a strut having an upper end and a lower end, each of the struts extending generally downwardly and inwardly from the platform to the cylinder receiver;

upper mounting means for pivotally mounting the upper end of each of the struts to the platform;

lower mounting means for pivotally mounting the lower end of each of the struts to the cylinder receiver; and a riser collar fixably receiving each the piston rods at the rod end, the riser collar supportably engaging the riser with the axes of the hydraulic cylinders substantially parallel with the axis of the riser, thereby tensioning the riser and allowing relative movement between the riser and the platform.

9. The apparatus as recited in claim 8, wherein the upper mounting means comprises:

a plurality of bearing seats having holes, each of the holes receiving the upper end of one of the struts, each of the bearing seats fixably attached to the platform;

a plurality of spherical bearings, each pivotally engaging one of the bearing seats, the spherical bearings having bores, each of the bores receiving one of the struts; and a plurality of fasteners, each secured to one of the struts above the bearing seats, affixing the spherical bearings therebetween.

10. The apparatus as recited in claim 8, wherein the lower mounting means comprises:

a plurality of bearing seats having holes, each of the holes receiving the lower end of one of the struts, the bearing seats fixably attached to the hydraulic cylinder receiver;

a plurality of spherical bearings rotatively engaging the bearing seats, the spherical bearings having bores, each of the bores receiving the lower end of one of the struts; and a plurality of fasteners, each secured to the lower end of one of the struts below the bearing seats, affixing the spherical bearings therebetween.

11. The apparatus as recited in claim 8, further comprising:

a guide sleeve fixably attached to the cylinder receiver, the guide sleeve being disposed within the cylinder receiver, the guide sleeve receiving the riser and being axially movable relative to the riser.

12. The apparatus as recited in claim 8, further comprising:

a guide sleeve being disposed within the cylinder receiver and fixably attached to the cylinder receiver, the guide sleeve receiving the riser and being axially movable relative to the riser; and upper and lower guide wheels mounted to upper and lower ends, respectively, of the guide sleeve, and rotatively engaging the riser.

13. The apparatus as recited in claim 8, wherein each of the hydraulic cylinders further comprises an accumulator extending from the base end coaxially along the axis of the hydraulic cylinder for accumulating the hydraulic fluid during compression of the hydraulic cylinder.

14. An apparatus for tensioning a riser having an axis, the riser extending downwardly from a platform to a subsea wellhead, the apparatus comprising:

a plurality of hydraulic cylinders each having an axis, a base end, a cylinder housing, a piston rod having a rod end and extending from the cylinder housing along the axis of the hydraulic cylinder, the cylinder housing containing fluid for urging the piston rod in a direction opposite the base end;

a cylinder receiver rigidly supporting each of the cylinder housings;

a plurality of flexible pads;

pad mounting means for mounting each of the flexible pads to the cylinder receiver for support on the platform; and a riser collar fixably receiving the piston rods proximate the rod ends, the riser collar supportably engaging the riser with the axes of the hydraulic cylinders being substantially parallel with the axis of the riser, thereby tensioning the riser and allowing relative movement between the riser and the platform.

15. The apparatus as recited in claim 14, further comprising:

a guide sleeve fixably attached to the cylinder receiver, the guide sleeve being disposed within the cylinder receiver, the guide sleeve receiving the riser and being axially movable relative to the riser.

16. The apparatus as recited in claim 14, further comprising:

a guide sleeve being disposed within the cylinder receiver and fixably attached to the cylinder receiver, the guide sleeve receiving the riser and being axially movable relative to the riser; and upper and lower guide wheels mounted to upper and lower ends, respectively, of the guide sleeve, and engaging the riser for axial rotation relative to the riser.

17. The apparatus as recited in claim 14, wherein each of the hydraulic cylinders further comprises an accumulator extending from the base end coaxially along the axis of the hydraulic cylinder for accumulating the hydraulic fluid during compression of the hydraulic cylinder.

18. The apparatus as recited in claim 14, wherein the pad mounting means mounts the flexible pads for pivotal movement between a contracted position for installation through a well slot in an upper floor portion of the platform and an expanded position of greater diameter when installed on a lower floor portion below the well slot in the platform.

* * * * *